US010968074B2

(12) United States Patent
Coldre

(10) Patent No.: US 10,968,074 B2
(45) Date of Patent: Apr. 6, 2021

(54) ELEVATOR CAR WALL IMAGING SYSTEM AND METHOD

(71) Applicants: OTIS ELEVATOR COMPANY, Farmington, CT (US); Laurent Coldre, Le neuville sur essonne (FR)

(72) Inventor: Laurent Coldre, Le neuville sur essonne (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 537 days.

(21) Appl. No.: 15/740,707

(22) PCT Filed: Jul. 3, 2015

(86) PCT No.: PCT/IB2015/001255
§ 371 (c)(1),
(2) Date: Dec. 28, 2017

(87) PCT Pub. No.: WO2017/006147
PCT Pub. Date: Jan. 12, 2017

(65) Prior Publication Data

US 2018/0186598 A1 Jul. 5, 2018

(51) Int. Cl.
*B66B 3/00* (2006.01)

(52) U.S. Cl.
CPC ..... *B66B 3/008* (2013.01)

(58) Field of Classification Search
CPC ..... B66B 3/008; B66B 9/00; B66B 11/0226; B66B 3/02
See application file for complete search history.

(56) References Cited

U.S. PATENT DOCUMENTS 5,004,225 A * 4/1991 Krukovsky ..... A63G 31/16 472/131
5,844,181 A 12/1998 Amo et al.
(Continued)

FOREIGN PATENT DOCUMENTS

CN 1942384 A 4/2007
CN 203461666 U 3/2014
(Continued)

OTHER PUBLICATIONS

International Search Report and Written Opinion regarding related PCT App. No. PCT/IB2015/001255; dated Mar. 11, 2016; 12 pgs.
(Continued)

*Primary Examiner* — Jeffrey Donels
(74) *Attorney, Agent, or Firm* — Cantor Colburn LLP

(57) ABSTRACT

An elevator car wall imaging system (20) is provided. The elevator car wall imaging system (20) includes an interior region of an elevator car, the interior region defined by a floor, a ceiling and a plurality of interior side walls. The elevator car wall imaging system (20) also includes an image generator (22) operatively connected to a network, the image generator (22) configured to generate an image on at least one a portion of at least one of the plurality of interior side walls, the image representing a weather condition currently present in an exterior environment surrounding a structure within which the elevator car is disposed.

11 Claims, 2 Drawing Sheets

(56) References Cited

U.S. PATENT DOCUMENTS

| | | | | |
|---|---|---|---|---|
| 6,076,638 | A * | 6/2000 | Gertz | B66B 3/00 187/414 |
| 6,082,500 | A | 7/2000 | Amo et al. | |
| 6,578,675 | B2 * | 6/2003 | Wilson | B66B 3/008 187/247 |
| 7,000,735 | B2 | 2/2006 | Meyer | |
| 7,270,219 | B2 | 9/2007 | Amo et al. | |
| 7,338,176 | B2 | 3/2008 | Svensson-Hilford et al. | |
| 7,878,308 | B2 | 2/2011 | Difranza et al. | |
| 8,869,947 | B2 | 10/2014 | Harkonen | |
| 10,197,401 | B1 * | 2/2019 | Hsu | G09F 19/22 |
| 10,221,039 | B2 * | 3/2019 | Hettema | B66B 11/0226 |
| 2005/0087403 | A1 * | 4/2005 | Mehr | G09F 19/22 187/396 |
| 2006/0065492 | A1 * | 3/2006 | Trifu | B66B 1/3415 187/396 |
| 2009/0031036 | A1 | 1/2009 | Hong et al. | |
| 2009/0057069 | A1 * | 3/2009 | Boggess | B66B 3/00 187/392 |
| 2010/0256823 | A1 | 10/2010 | Cherukuri et al. | |
| 2012/0256945 | A1 * | 10/2012 | Kidron | B66B 3/008 345/619 |
| 2013/0346550 | A1 | 12/2013 | Higgins | |
| 2018/0079619 | A1 * | 3/2018 | Ben Abat | B66B 3/008 |

FOREIGN PATENT DOCUMENTS

| | | | |
|---|---|---|---|
| EP | 1069065 | A1 | 1/2001 |
| EP | 2072442 | A1 | 6/2009 |
| JP | 2005338833 | | 8/2005 |
| WO | 0012420 | A1 | 3/2000 |
| WO | 2007052261 | A2 | 5/2007 |

OTHER PUBLICATIONS

Office Action regarding related CN App. No. 2015800814407; dated Jan. 18, 2019; 2 pgs.

* cited by examiner

ELEVATOR CAR WALL IMAGING SYSTEM AND METHOD

CROSS-REFERENCE TO RELATED APPLICATIONS

This patent application is a National Stage Application of International Patent Application Serial No. PCT/IB2015/001255, filed Jul. 3, 2015, which is incorporated herein by reference in its entirety.

BACKGROUND OF THE DISCLOSURE

The embodiments herein relate to elevator systems and, more particularly, to an elevator car wall imaging system, as well as a method associated with providing elevator car wall images.

Elevators provide many conveniences to users. For example, passengers are able to forego having to climb flights of stairs to reach their desired floor. Additionally, heavy cargo may be easily transported. These well-known conveniences outweigh, but are countered by what some passengers consider undesirable aspects of elevator transport. For example, users are often met with a lack of information while in the elevator car and some passengers suffer from claustrophobia stemming from a lack of space within the interior region of the elevator car.

BRIEF DESCRIPTION OF THE DISCLOSURE

According to one embodiment, an elevator car wall imaging system is provided. The elevator car wall imaging system includes an interior region of an elevator car, the interior region defined by a floor, a ceiling and a plurality of interior side walls. The elevator car wall imaging system also includes an image generator operatively connected to a network, the image generator configured to generate an image on at least a portion of at least one of the plurality of interior side walls, the image representing a weather condition currently present in an exterior environment surrounding a structure within which the elevator car is disposed.

In addition to one or more of the features described above, or as an alternative, further embodiments may include that the image generator comprises a projection system.

In addition to one or more of the features described above, or as an alternative, further embodiments may include that the projection system is operatively coupled to at least one of the ceiling and the floor of the elevator car.

In addition to one or more of the features described above, or as an alternative, further embodiments may include that at least one of the plurality of interior side walls comprises a transparent material layer, a reflective film layer and a backlight layer.

In addition to one or more of the features described above, or as an alternative, further embodiments may include that the transparent material layer comprises inclusions.

In addition to one or more of the features described above, or as an alternative, further embodiments may include a sound generation device operatively connected to the network, the sound generation device configured to produce a sound representing the weather condition currently present in the exterior environment surrounding the structure.

In addition to one or more of the features described above, or as an alternative, further embodiments may include that the sound comprises precipitation and wind.

In addition to one or more of the features described above, or as an alternative, further embodiments may include that the image representing the weather condition comprises precipitation, clouds, clear skies and wind.

In addition to one or more of the features described above, or as an alternative, further embodiments may include that the network accesses real-time information about current weather conditions.

According to another embodiment of the disclosure, a method of informing an elevator car passenger of a weather condition is provided. The method includes displaying an image on at least one of a plurality of interior side walls of the elevator car, the image representing a weather condition currently present in an exterior environment surrounding a structure within which the elevator car is disposed.

In addition to one or more of the features described above, or as an alternative, further embodiments may include generating a sound audible to an interior region of the elevator car, the sound representing the weather condition currently present in the exterior environment surrounding the structure.

In addition to one or more of the features described above, or as an alternative, further embodiments may include that the image is generated with an image generator operatively connected to a network configured to access real-time information about current weather conditions.

In addition to one or more of the features described above, or as an alternative, further embodiments may include that the image generator comprises a projection system.

In addition to one or more of the features described above, or as an alternative, further embodiments may include that the image generator is configured to generate an image on all of the plurality of interior side walls.

BRIEF DESCRIPTION OF THE DRAWINGS

The subject matter which is regarded as the disclosure is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION OF THE DISCLOSURE

Figure 1:
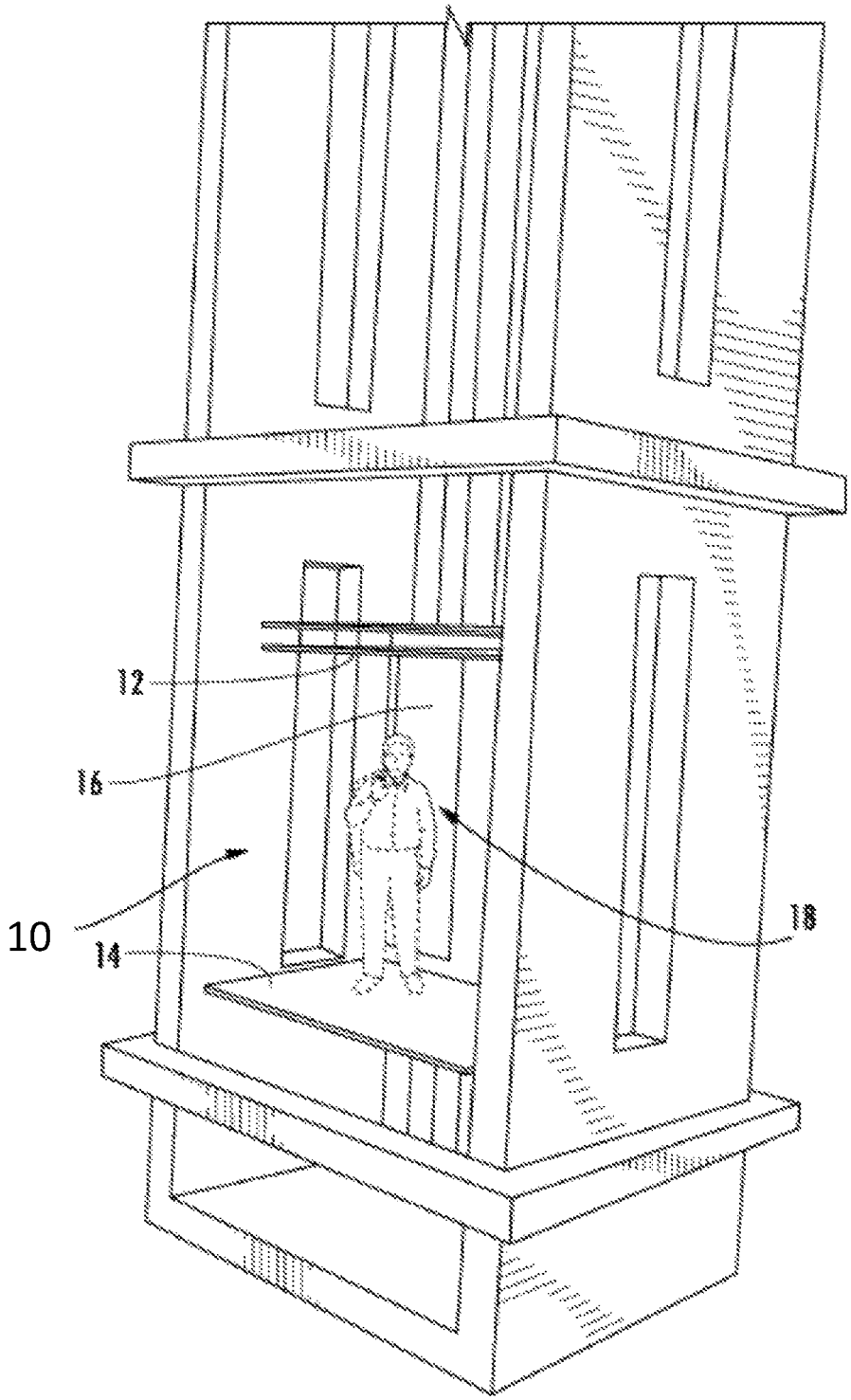
FIG. 1 is a perspective view of an elevator car.

Referring to FIG. 1, an elevator car 10 is illustrated. The elevator car 10 moves along guide rails of an elevator shaft in a known manner. The elevator car 10 is disposed within the elevator shaft and is moveable therein, typically in a vertical manner. The elevator car 10 includes a ceiling 12, a floor 14 and a plurality of interior side walls 16. Together, the ceiling 12, the floor 14 and the plurality of interior side walls 16 define an interior region 18 that is dimensioned to carry standing passengers and/or cargo during operation of the elevator car 10 within the overall elevator system.

Figure 2:
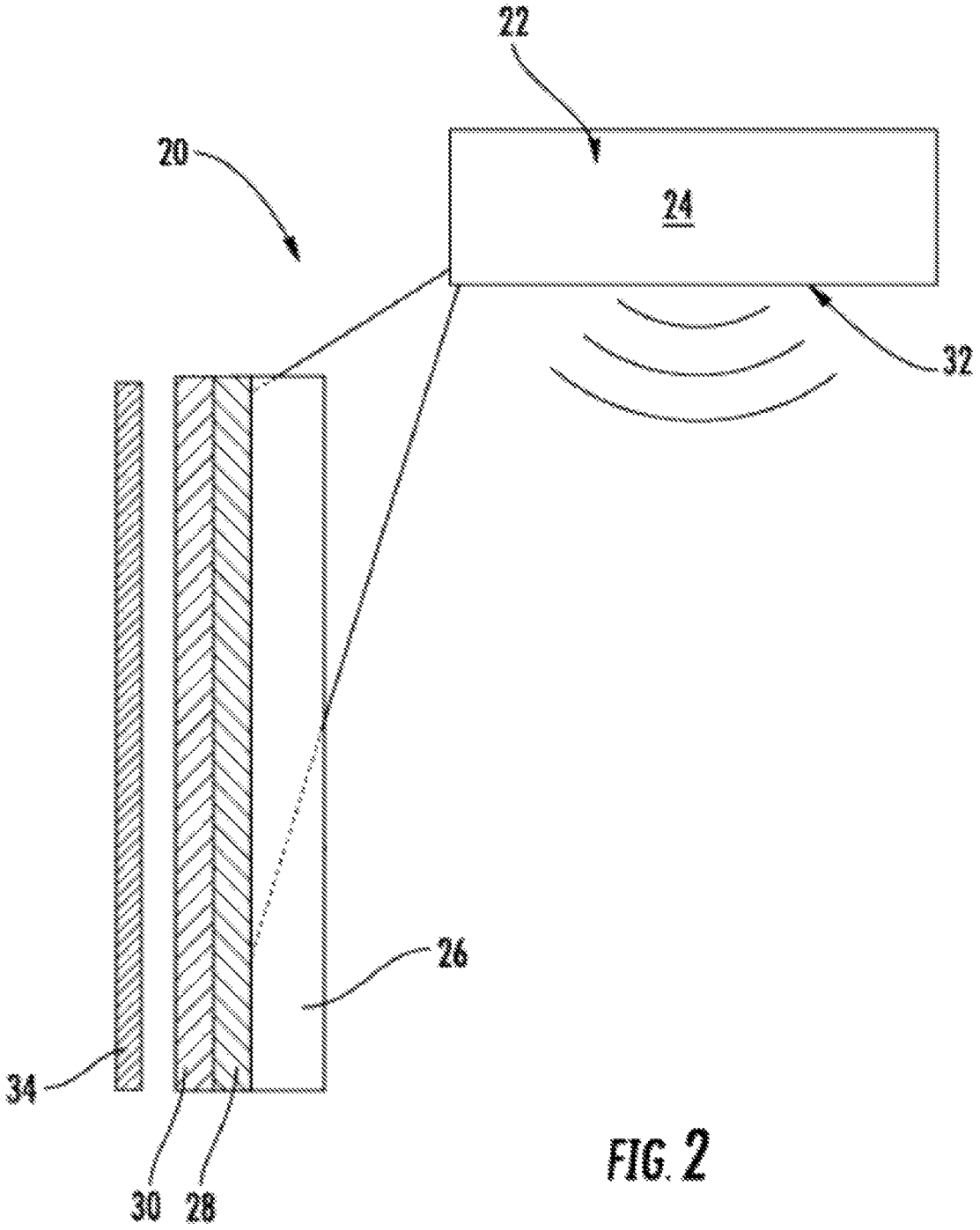
FIG. 2 is a schematic illustration of an elevator car wall imaging system.

Referring to FIG. 2, an elevator car wall imaging system 20 is illustrated and employed in conjunction with the elevator car 10. In particular, the elevator car wall imaging system 20 is configured to generate an image on or within an interior surface of the elevator car 10. The term "image" refers to any visual depiction that is viewable by a passenger in the elevator car 10. By way of non-limiting example, images may be symbols, pictures, animations, movies, patterns, colors, and/or multiple images could be applicable. Furthermore, the image could be high or low definition.

The image is visible to passengers located within the interior region 18 of the elevator car 10. The image is typically displayed on at least one of the plurality of interior side walls 16, however, it is contemplated that the image is displayed on the ceiling 12 and/or floor 14 in conjunction with, or as an alternative to, the displayed image on the interior side wall(s) 16. As such, the image(s) may be displayed on all interior surfaces or less than all of the interior surfaces. It is to be further understood that the image may be displayed on only a portion of the interior surface(s) rather than an entire surface of one or more of the interior surfaces.

The image visible to passengers in the elevator car 10 is modifiable based on real-time information that is accessed by a network. The network is in wired or wireless connection with an image generator 22 that generates the image. The information that is accessible may vary. For example, the information may relate to news, weather, stock market reports, etc. By way of non-limiting example, images relating to weather provide an enhanced atmosphere in the elevator car 10 when compared to traditional interior walls of an elevator. To reduce the possibility of claustrophobia or boredom, for example, of a passenger during use of an elevator, the images provided within the interior space present a more pleasurable experience during transit. Weather conditions may be simulated within the elevator car 10 to provide the effect of a glass or open enclosure rather than the walls of a traditional elevator car.

The simulated weather conditions may include precipitation in the form of rain, sleet, snow or hail. Other conditions that may be simulated include wind, a clear or sunny sky, and clouds to simulate overcast conditions. Although it is contemplated that the simulated weather conditions may be randomly selected or chosen from some desirable climate, in some embodiments the simulated weather conditions are based on the current and local weather conditions. The phrase "current and local weather conditions" refers to weather conditions currently present in an exterior environment surrounding a structure within which the elevator car is disposed.

As noted above, the image(s) are generated by the image generator 22. The image generator 22 comprises any system that is capable of communicating with the network and generating an image on or within at least one of the interior surfaces of the elevator car 10, such as at least one of the plurality of interior side walls 16. As shown, the image generator 22 may be operatively coupled to the ceiling 12 of the elevator car 10, but it is to be understood that the image generator 22 may be coupled to the floor 14, another side wall or embedded within one of the side walls. In the embodiment illustrated in FIG. 2, the image generator 22 is a projection system that includes a projector 24. The projector 24 projects light and/or laser toward at least one of the plurality of interior side walls 16. In some embodiments, the plurality of interior side walls 16 includes multiple layers that enhance the image generated by the projector 24. For example, a transparent material layer 26, such as glass, may be on the surface of the wall. The transparent material layer 26 may include objects included therein or on the surface to provide enhanced perspective to the images viewed thereon. Adjacent to the transparent material layer 26 is a reflective film 28 in some embodiments. Adjacent to the reflective film 28 is a background image layer 30 in some embodiments. The background image layer 30 may provide a constant background image, such as the immediately surrounding building environment. Back lighting 34 may also be employed and modulated regarding the time of day. Modulation includes light intensity, dominant color and heat.

As an alternative to the projection system described above, alternative systems may be employed as the image generator 22. For example, a system may be fully embedded within the side wall that the image is to be displayed on.

In addition to the images visible to the passengers, a sound generation device 32 is included in some embodiments. The sound generation device 32 may be fully integrated with the image generator 22, as shown in FIG. 2. Regardless of whether the sound generation device 32 is integrated with the image generator 22, the sound generation device produces a sound that represents the weather condition being displayed to the passengers. For example, the sound may represent the weather condition currently present in the exterior environment surrounding the structure within which the elevator car 10 is disposed. The sounds produced may be in the form of wind, precipitation, etc.

Advantageously, the elevator car wall imaging system 20 provides both information and sensitive experience to the passengers within the elevator car. This allows the passengers to avoid common unpleasant experiences, such as claustrophobia and enhances the overall riding experience to individuals being transported within the elevator car 10. The information provided to the passengers allows them to prepare for the weather conditions awaiting them upon reaching the ground level in preparation for exiting of the structure.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. An elevator car wall imaging system comprising:

an interior region of an elevator car, the interior region defined by a floor, a ceiling and a plurality of interior side walls; and an image generator operatively connected to a network, the image generator configured to generate an image on at least a portion of at least one of the plurality of interior side walls, the image representing a weather condition currently present in an exterior environment surrounding a structure within which the elevator car is disposed;

wherein the image generator comprises a projection system;

wherein at least one of the plurality of interior side walls comprises a transparent material layer, a reflective film layer and a backlight layer.

2. The elevator car wall imaging system of claim 1, wherein the projection system is operatively coupled to at least one of the ceiling and the floor of the elevator car.

3. The elevator car wall imaging system of claim 1, wherein the transparent material layer comprises inclusions.

4. The elevator car wall imaging system of claim 1, wherein the network accesses real-time information about current weather conditions.

5. An elevator car wall imaging system comprising:

an interior region of an elevator car, the interior region defined by a floor, a ceiling and a plurality of interior side walls;

an image generator operatively connected to a network, the image generator configured to generate an image on at least a portion of at least one of the plurality of interior side walls, the image representing a weather condition currently present in an exterior environment surrounding a structure within which the elevator car is disposed;

a sound generation device operatively connected to the network, the sound generation device configured to produce a sound representing the weather condition currently present in the exterior environment surrounding the structure.

6. The elevator car wall imaging system of claim 5, wherein the sound comprises precipitation and wind.

7. An elevator car wall imaging system comprising:

an interior region of an elevator car, the interior region defined by a floor, a ceiling and a plurality of interior side walls; and an image generator operatively connected to a network, the image generator configured to generate an image on at least a portion of at least one of the plurality of interior side walls, the image representing a weather condition currently present in an exterior environment surrounding a structure within which the elevator car is disposed;

wherein the image representing the weather condition comprises precipitation, clouds, clear skies and wind.

8. A method of informing an elevator car passenger of a weather condition, the method comprising:

displaying an image on at least one of a plurality of interior side walls of the elevator car, the image representing a weather condition currently present in an exterior environment surrounding a structure within which the elevator car is disposed;

generating a sound audible to an interior region of the elevator car, the sound representing the weather condition currently present in the exterior environment surrounding the structure.

9. The method of claim 8, wherein the image is generated with an image generator operatively connected to a network configured to access real-time information about current weather conditions.

10. The method of claim 8, wherein the image generator comprises a projection system.

11. The method of claim 8, wherein the image generator is configured to generate an image on all of the plurality of interior side walls.

* * * * *